US005630776A

United States Patent [19]

Yang

[11] Patent Number: 5,630,776

[45] Date of Patent: May 20, 1997

[54] FOLDING DUMBELL REST

[76] Inventor: Lien-Chuan Yang, 11F 1, No. 149, Sec. 3, Roosevelt Rd., Taipei, Taiwan

[21] Appl. No.: 662,357

[22] Filed: Jun. 12, 1996

[51] Int. Cl.[6] ..... A63B 21/072

[52] U.S. Cl. ..... 482/104; 211/198; 294/143

[58] Field of Search ..... 482/104, 108; 211/60.1, 198; 294/143

[56] References Cited

U.S. PATENT DOCUMENTS 4,666,038 5/1987 Minneman ..... 294/143 X

*Primary Examiner*—Richard J. Apley
*Assistant Examiner*—John Mulcahy
*Attorney, Agent, or Firm*—Bacon & Thomas

[57] ABSTRACT

A folding dumbbell rest includes a handle attached to a V-shaped plate. A pair of cylinders have sloped top ends rotatably attached to a respective side of the V-shaped plate for rotation between open and closed positions. The bottom ends of the cylinders have horizontal and inclined cut faces. One side of each cylinder is provided with notches for holding the handles of dumbbells. When the cylinders are rotated to the closed position, the notches are on the inside and the cylinders stand upright on the horizontal cut faces and the dumbbell rest may be hand-carried. When the cylinders are rotated to the open position, the notches are on the outside and the cylinders stand inclined on the inclined cut faces. The cylinders may be locked in either the open or closed position.

4 Claims, 5 Drawing Sheets

FOLDING DUMBELL REST

BACKGROUND OF THE INVENTION

The present invention relates to a dumbbell rest including a handle and two rotatable cylinders. The cylinders can be rotated open and close for exhibiting the dumbbells in an exercising site or a shop and easily carrying the dumbbells rested therein.

A conventional dumbbell is formed by a bar member and two heavy bodies disposed at two ends of the bar member and having equal weight. Generally the dumbbell is made of metal material. The weight of the dumbbell is divided into several degrees according to the physical ability of different users. When exercising different parts of the body, a user must use a dumbbell with suitable weight so as to avoid injury. The dumbbell is usually rested on a fixed dumbbell rest or placed on a corner and is rarely carried with the user.

SUMMARY OF THE INVENTION

It is therefore a primary object of the present invention to provide a dumbbell rest which permits the dumbbells rested therein to be exhibited in an exercising site or a shop and which enables a user to easily carry the dumbbells.

According to the above object, the dumbbell rest of the present invention includes a handle, a V-shaped plate, two cylinders each having a single opening at at bottom end and a connecting device. The handle integrally connected with the V-shaped plate which has two ends slightly upwardly inclined from the center. Each end of the V-shaped plate is formed with a hole. A top end of each cylinder is formed with a slope face corresponding to the slope face of the V-shaped plate. The slope face is formed with a hole at the center. The bottom end of the cylinder is formed with a horizontal cut face and an inclined cut face. The cylinders are further respectively formed with several pairs of opposite notches on inner sides for resting dumbbells therein.

The connecting device is passed through the hole of the V-shaped plate and the hole of the cylinder to associate the V-shaped plate with the cylinder. The slope face of the cylinder and the slope face of the V-shaped plate are freely rotatably attached to each other. When the two cylinders are rotated to be normal to each other, the horizontal cut faces of the bottoms thereof enable the cylinders to stand upright. On the other hand, when the cylinders are rotated open, the slope faces of the cylinders and the slope faces of the V-shaped plate cooperate with each other to make the cylinders stretched open into a triangular rest body. At this time, the inclined cut faces of the cylinders together form a planar face enabling the cylinders to stand inclined.

The present invention can be best understood through the following description and accompanying drawings, wherein:

DETAILED DESCRIPTION OF THE PREFERRED EMBODIMENT

Figure 1:
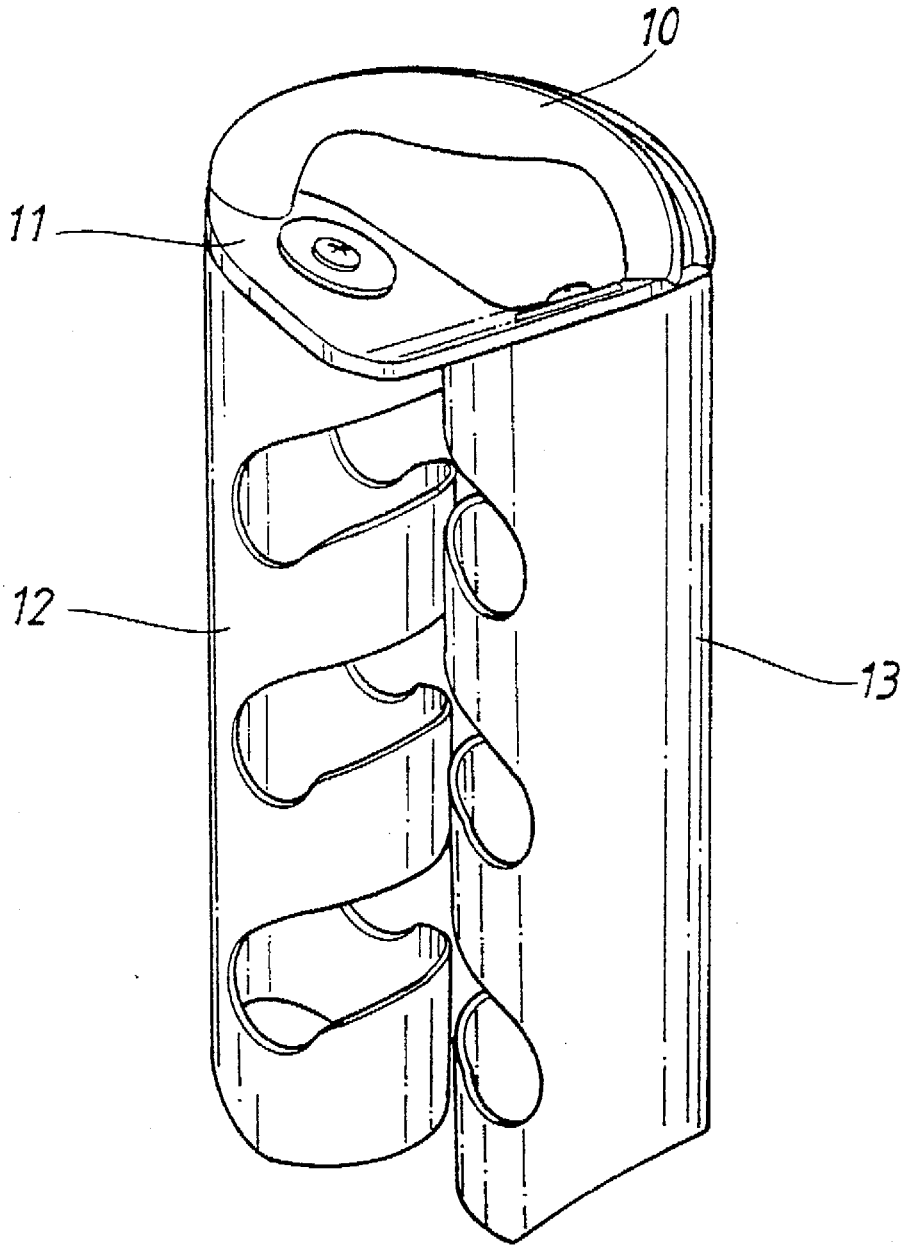
FIG. 1 is a perspective assembled view of the present invention.
Figures 2, 2A:
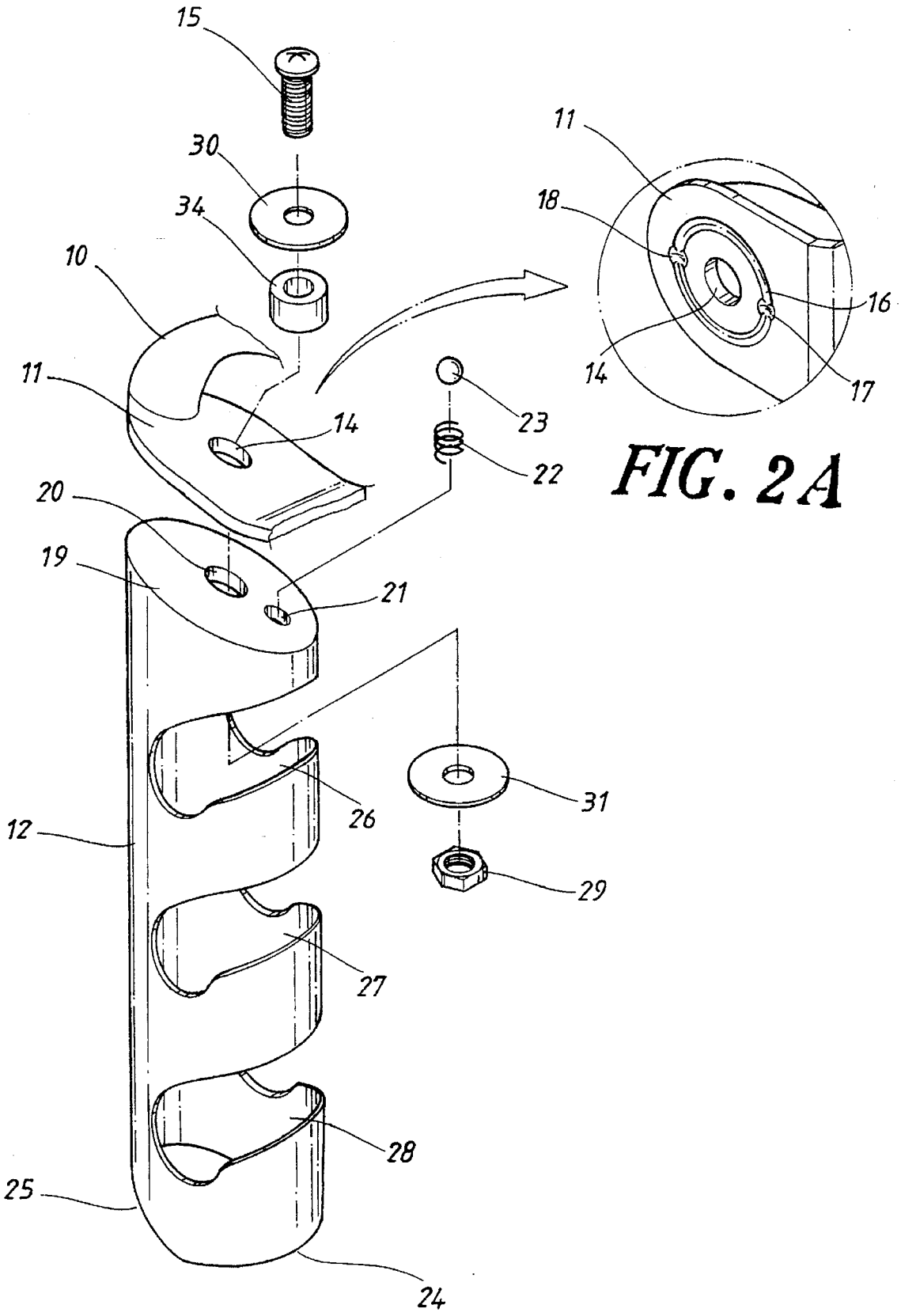
FIG. 2 is a perspective exploded view of a part of the present invention.

Please refer to FIGS. 1 and 2. According to a preferred embodiment, the present invention includes a handle 10, a V-shaped plate 11, two cylinders 12, 13 each having a single opening at bottom end and a connecting device. The handle 10 is integrally connected with the V-shaped plate 11. The V-shaped plate 11 is an elliptic plate body having two ends slightly upwardly inclined from the center. Each end of the V-shaped plate 11 is formed with a hole 14, whereby a screw 15 and a sleeve 34 of the connecting device are passed through the hole 14 to associate with the cylinder 12. An annular groove 16 is formed on the bottom of the V-shaped plate 11 around each hole 14. Two ends (180 degrees spaced) of the annular groove 16 are additionally formed with two stopping recesses 17, 18 respectively. The two cylinders 12, 13 are identical to each other. The top end of each cylinder is formed with a slope face 19 corresponding to the slope face of the V-shaped plate 11. The slope face 19 is formed with a hole 20 at the center and a dent 21 on inner side corresponding to the stopping recess 17 of the V-shaped plate 11. A spring 22 and a ball member 23 are disposed in the dent 21. The bottom end of the cylinder 12 is formed with a horizontal cut face 24 and an inclined cut face 25. In addition, the cylinders 12, 13 are respectively formed with three pairs of opposite notches 26, 27, 28 on inner sides for resting dumbbells with different weights therein.

Figure 3:
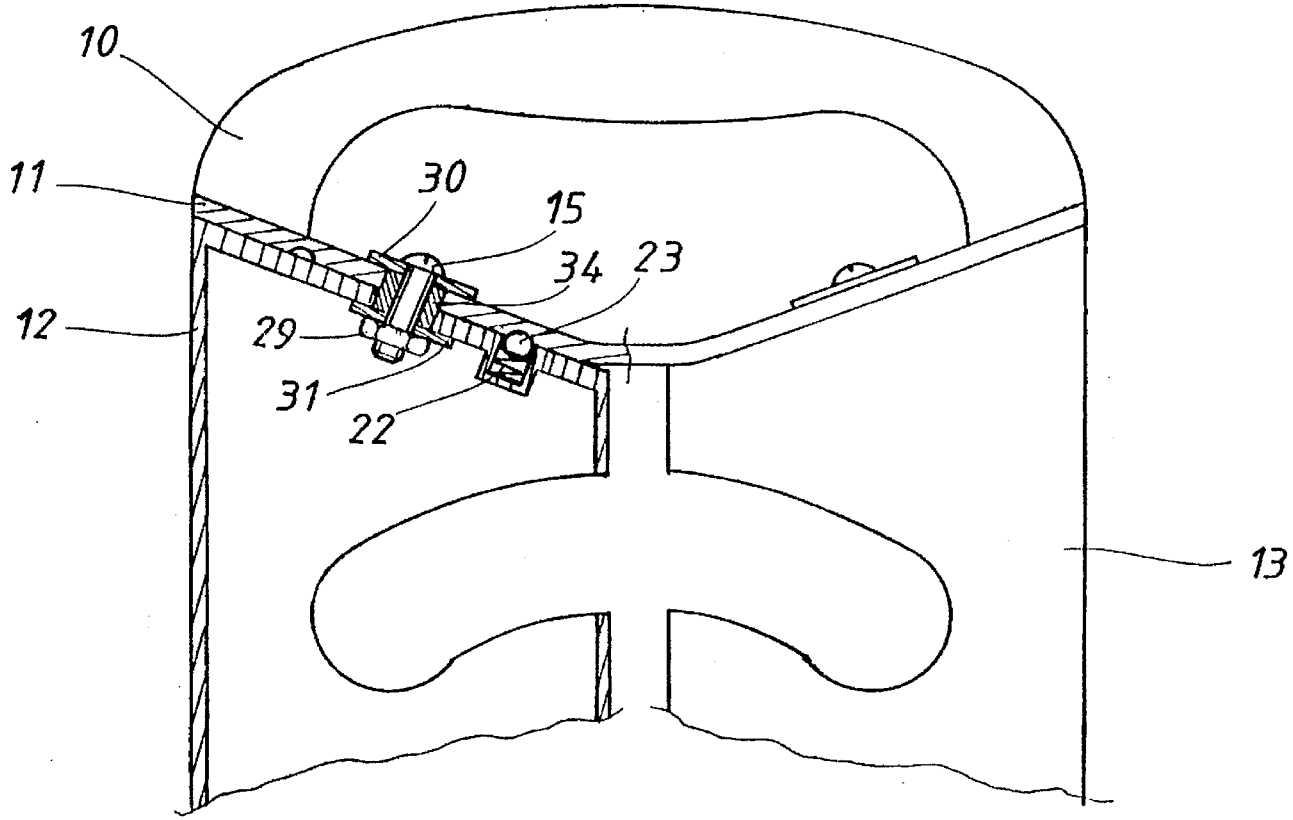
FIG. 3 is a sectional view of a part of the present invention.

Referring to FIG. 3, the connecting device includes a screw 15, a sleeve 34, a nut 29 and a first and a second washers 30, 31. The screw 15 is passed through the first washer 30 and the sleeve 34 is fitted around the screw 15 to be both passed through the hole 14 of the V-shaped plate 11 and the hole 20 of the cylinder 12. Then the screw 15 is passed through the second washer 31 on lower side to be tightened by the nut 29 through the notch 26. Accordingly, the slope face 19 of the cylinder 12 and the slope face of the V-shaped plate 11 are freely rotatably attached to each other. The sleeve 34 serves to prevent the peripheral walls of the holes 14, 20 from being worn during rotation. Preferably, the thickness of the slope face 19 of the cylinder 12 is equal to the thickness of the V-shaped plate 11 to achieve a better structure.

Figure 4:
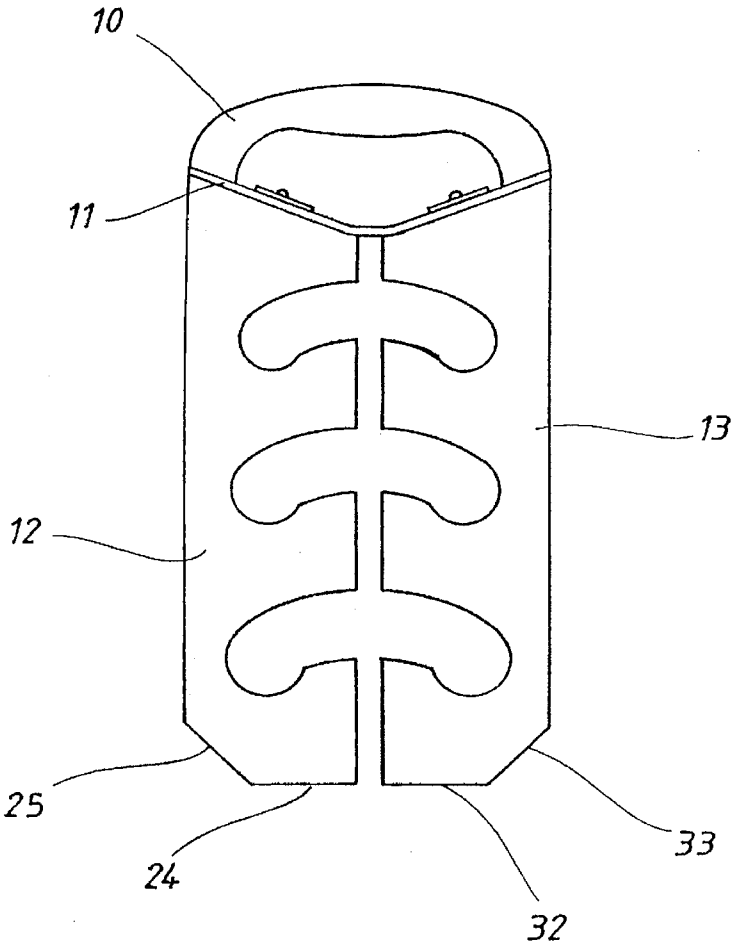
FIG. 4 shows that the cylinders of the present invention are rotated close.
Figure 5:
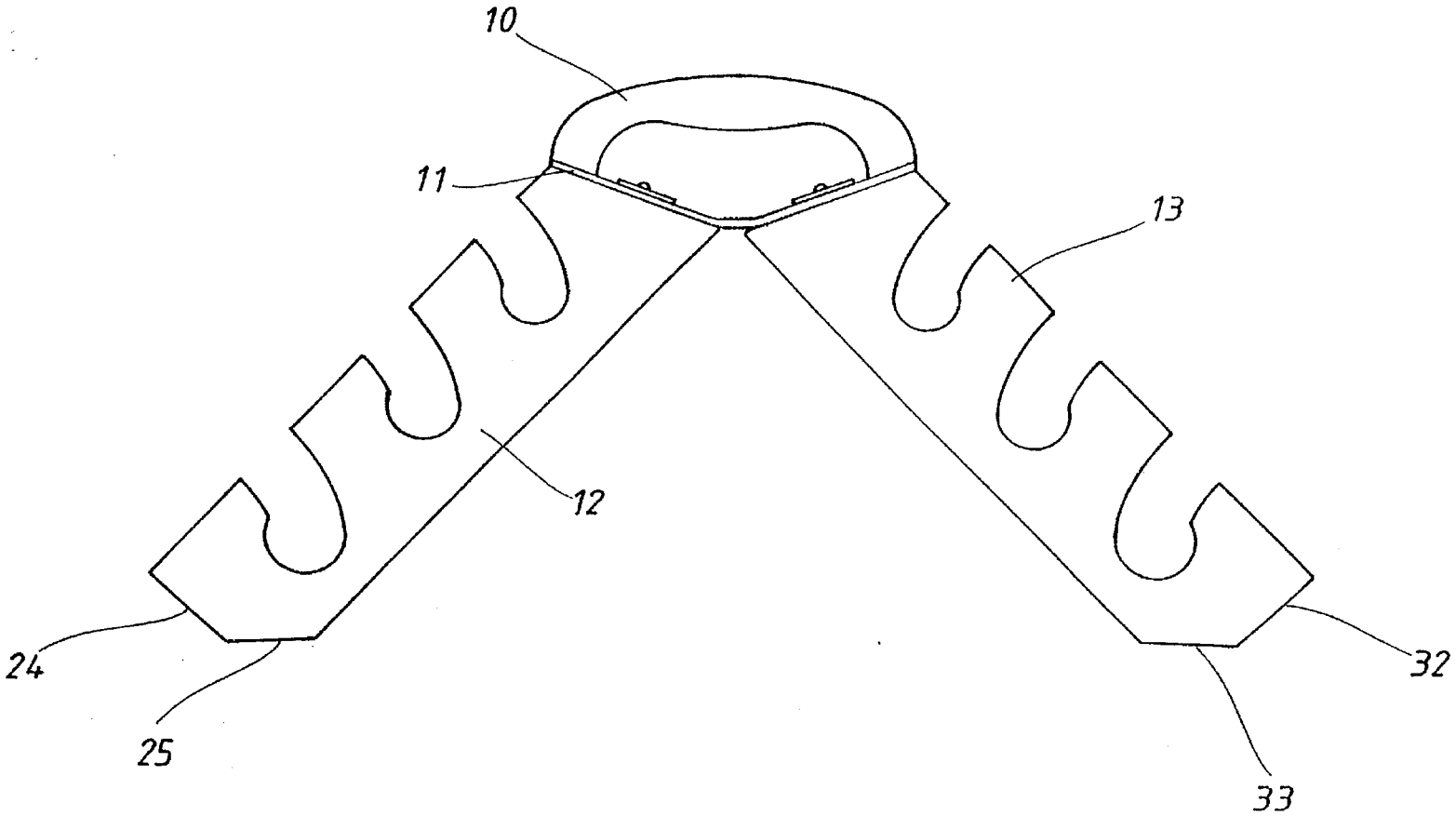
FIG. 5 shows that the cylinders of the present invention are rotated open.

Please refer to FIGS. 4 and 5. When the two cylinders 12, 13 are rotated to be normal to each other, the horizontal cut faces 24, 32 of the bottoms thereof enable the cylinders 12, 13 to stand upright. At this time, the ball members 23 in the dents 21 are stopped in the inner stopping recesses 17 so as to prevent the cylinders from swinging and facilitate carriage of the dumbbell rest. On the other hand, when the cylinders 12, 13 are rotated open, the slope faces of the cylinders and the slope faces of the V-shaped plate cooperate with each other to make the cylinders stretched open into a triangular rest body.

At this time, the inclined cut faces 25, 33 of the cylinders 12, 13 together form a planar face enabling the cylinders to stand inclined. During the outward rotation of the cylinders, the ball members 23 roll away from the inner stopping recesses 17 along the annular groove 16 to the outer stopping recesses 18. At this time, the cylinders 12, 13 are just rotated through 180 degrees to form the triangular rest body. The ball members stopped in the outer stopping recesses 18 serve to ensure that the dumbbell stably stand after resting dumbbells thereon without falling down due to unstable gravity center. The dumbbell rest can be placed in such manner as aforesaid in an exercising site so as to conveniently take out dumbbells with different weights. Alternatively, the dumbbell rest can be placed in an exhibition site for showing the dumbbells to a consumer. The consumer can purchase and directly carry the dumbbell rest together with the dumbbells home. Therefore, the dumbbell rest of the present invention facilitates the carriage and exhibition as well as storage of the dumbbell.

It should be noted that the above description and accompanying drawings are only used to illustrate some embodiments of the present invention, not intended to limit the scope thereof. Any modification of the embodiments should fall within the scope of the present invention.

What is claimed is:

1. A dumbbell rest comprising a handle, a V-shaped plate, two cylinders and a pair of connecting devices, wherein:

the handle is attached to the V-shaped plate;

the V-shaped plate being a plate body having two ends slightly upwardly inclined from the center, each end of the V-shaped plate being formed with a hole;

a top end of each cylinder is formed with a slope face corresponding to a respective end of the V-shaped plate, the slope face being formed with a hole at the center, the bottom end of each cylinder being formed with a horizontal cut face and an inclined cut face, the cylinders being further respectively formed with several pairs of opposite notches on their sides for resting dumbbells therein; and the connecting devices are passed through a respective hole of the V-shaped plate and the hole of the respective cylinder to rotatably associate the V-shaped plate with the cylinders, the slope faces of the cylinders being freely rotatably attached to the V-shaped plate, whereby when the two cylinders are rotated to a closed position, the horizontal cut faces of the bottoms thereof enable the cylinders to stand upright, while when the cylinders are rotated to an open position, the slope faces of the cylinders and the inclined ends of the V-shaped plate cooperate with each other to make the cylinders into a triangular rest body and the inclined cut faces of the cylinders together form a planar face enabling the cylinders to stand inclined.

2. A dumbbell rest as claimed in claim 1, wherein the V-shaped plate is integrally connected with the handle and the thickness of the V-shaped plate is equal to the thickness of the slope face of the cylinder.

3. A dumbbell rest as claimed in claim 1, wherein an annular groove is formed on the bottom of the V-shaped plate around each hole thereof and two ends of the annular groove, which are 180 degrees spaced, are additionally formed with an inner and outer stopping recesses respectively, the slope face of the cylinder being formed with a dent on an inner side corresponding to the inner stopping recess of the V-shaped plate, a spring and a ball member being disposed in the dent.

4. A dumbbell rest as claimed in claim 1, wherein each connecting device includes a screw, a sleeve, a nut snd washers.

* * * * *